United States Patent [19]

Hemminger

[11] Patent Number: 5,044,829

[45] **Date of Patent: * Sep. 3, 1991**

[54] MOORING SYSTEM

[76] Inventor: Paul W. Hemminger, Rte. 4, Box 1466, Eufaula, Okla. 74432

[ * ] Notice: The portion of the term of this patent subsequent to Feb. 5, 2008 has been disclaimed.

[21] Appl. No.: 608,211

[22] Filed: Nov. 2, 1990

Related U.S. Application Data

[63] Continuation of Ser. No. 229,145, Aug. 5, 1988, Pat. No. 4,990,029.

[51] Int. Cl.[5] ..... E01D 1/00; E02B 3/20

[52] U.S. Cl. ..... 405/203; 405/202; 405/219; 405/220; 405/227; 403/119; 114/230; 114/264; 14/71.5; 14/72.5

[58] Field of Search ..... 405/195, 202–203, 405/218–221, 227; 403/113, 119; 16/255; 14/27, 29, 71.5, 72.5; 114/49, 264–266, 230

[56] References Cited

U.S. PATENT DOCUMENTS

| | | | |
|---|---|---|---|
| 2,715,314 | 8/1955 | Smith | 405/219 |
| 3,131,542 | 5/1964 | Koch | 405/219 |
| 3,421,327 | 1/1969 | Donaldson | 405/220 |
| 3,492,825 | 2/1970 | Pearson | 405/219 |
| 3,952,528 | 4/1976 | Donkersloot | 405/221 |
| 4,003,473 | 1/1977 | Ryan | 114/230 |
| 4,035,861 | 7/1977 | Edge | 14/72.5 |
| 4,083,072 | 4/1978 | Ryan | 405/219 X |
| 4,133,283 | 1/1979 | Ryan | 114/230 |
| 4,335,981 | 6/1982 | Akiyama et al. | 405/221 |
| 4,581,784 | 4/1986 | Rousseau et al. | 405/219 X |
| 4,590,634 | 5/1986 | Williams | 14/27 X |
| 4,838,735 | 6/1989 | Warner | 405/220 |
| 4,990,029 | 2/1991 | Hemminger | 405/203 |

*Primary Examiner*—David H. Corbin
*Assistant Examiner*—Franco S. De Liguori
*Attorney, Agent, or Firm*—Steven D. Hemminger; Paul W. Hemminger

[57] ABSTRACT

A mooring system comprising a multiple degree of freedom coupler interconnecting a floatation section and an anchoring section of a dock system. The system also comprises a drawbridge section, a gangway section and a shoreline mooring section. The multiple degree of freedom coupler prevents hanging-up of the floatation sections which is an expensive, frequently occurring problem experienced by virtually every free floating anchor/sleeve dock system currently in existence.

5 Claims, 8 Drawing Sheets

MOORING SYSTEM

This is a continuation of co-pending application Ser. No. 229,145, filed on Aug. 5, 1988 now U.S. Pat. No. 4,990,029.

BACKGROUND

1. Field of the Invention

The field of the present invention is mooring systems; more specifically, mooring systems for use on a body of water whose water level is subject to change and is subject to rough weather.

2. The Prior Art

An example of a prior art mooring systems is depicted in FIG. 7. These generally consist of a platform attached to four vertical pencil anchors with rigid sleeves. In very calm waters, these systems perform adequately. In rough water or when the frequency of the waves is less than the length of the platform, they are woefully inadequate. In rough water, one end of the platform may be on a crest of a wave as the other end is entering a trough. When this happens the platform will tilt, creating a rotational force on the sleeve causing them to gouge in and thus "hang up" on the pencil anchors. If the rough weather continues the sleeves will become even more securely locked in place, changing the floatation platform to a fixed platform. If the water is rough enough the dock will be unusable until freed.

Because of the size of these docks freeing a dock that has been hung up is not an easy task and requires heavy duty equipment generally not owned or easily available to the normal dock owner. On lakes under the jurisdiction of the Army Corp of Engineers, they must routinely free hung up docks after heavy weather many times using heavy equipment. Not only doe this waste time and money, but until the docks are freed they may be unusable and also look unsightly, making the lake look run down.

SUMMARY OF THE INVENTION

The mooring system of the present invention comprises a multiple degree of freedom coupler interconnecting a floatation section and an anchoring section of a dock system. The system also comprises a drawbridge section, a gangway section and a shoreline mooring section. The multiple degree of freedom coupler prevents hanging-up of the floatation sections which is an expensive, frequently occurring problem experienced by virtually every free floating anchor/sleeve dock system currently in existence.

DETAILED DESCRIPTION OF THE PREFERRED EMBODIMENT

Figure 1:
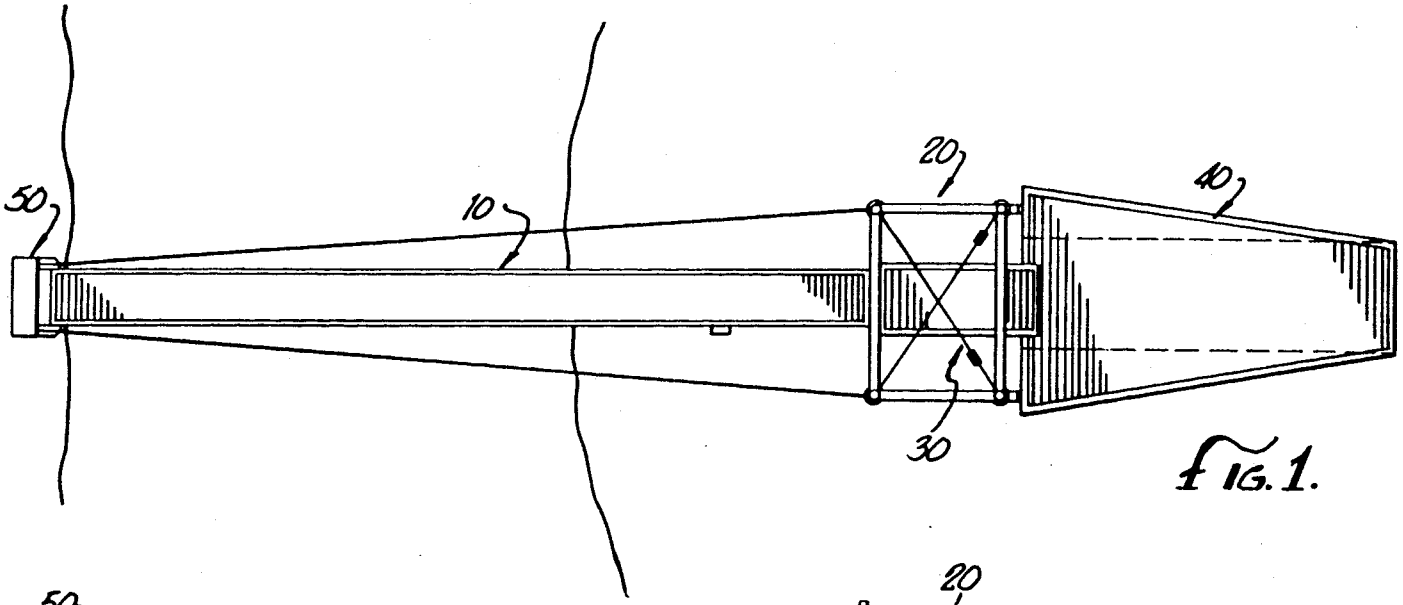
FIG. 1 is an overhead plan view of a dock system incorporating the preferred embodiment of the present invention.

The preferred embodiment of the present invention when it is being utilized on a manmade lake with a controlled water level as shown in FIGS. 1 and 2, comprises a gangway section 10, an anchoring section 20, a drawbridge section 30, a floatation section 40 and a shoreline mooring section 50.

THE SHORELINE MOORING SECTION

Figure 6:
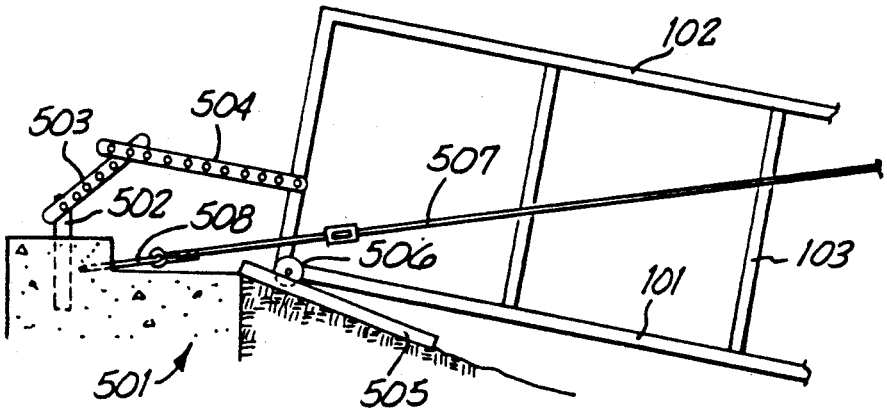
FIG. 6 is a partial side view of the shore attachment section of the dock system of FIG. 1.
Figure 7:
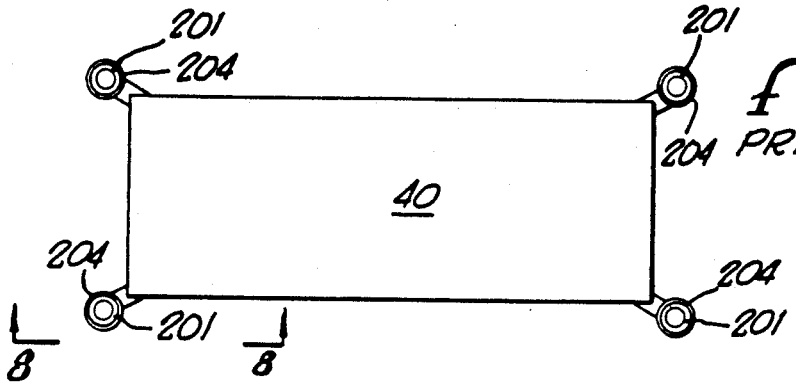
FIG. 7. PRIOR ART
FIG. 7 is a top view of a section of a prior art dock.

The shoreline mooring section 50 is best shown in FIG. 6. A base 501 is preferably constructed of concrete or natural occurring rock formation. A bar 502 is securely embedded in the base 501, preferably vertically in two places in the base 501, corresponding to the width of the gangway section 10. The preferred method of securing the gangway section to the base includes identical attachment of each side of said gangway section. For simplicity sake, only one side is described. Two adjustable support bars 503 and 504 connect the gangway section to the shoreline mooring section. For ease in adjustment the bars 502, the support bars 503 and 504 and the gangway section 10 are bolted together. The support bars 503 and 504 are preferably formed of one quarter inch steel flat stock with a plurality of through holes along their longitudinal centerlines to provide adjustment to compensate for the changes in position of the gangway section with respect to the shore when the water level is changed. They can also serve to limit movement of the anchor section during rough weather. A runner 505 is secured to the shore and is formed to provide a channel for a roller 506, rotatably attached to one end of the gangway section 10, to travel. The roller 506 and runner 505 combination facilitates adjustment of the gangway section 10 when compensating for water level changes. The runner 505 is preferably constructed of 3 inch heavy duty steel channel and the roller preferably is a 4 inch diameter hard rubber, ball bearing, caster. When the anchoring section is resting on a rocky bottom, it was found advantageous to connect a guy wire 507 between an eyehook 508 embedded in the base 501 and an appropriate member of the anchor section 20. This helps keep the weight of the gangway section from forcing the anchor section in a waterward direction.

THE GANGWAY SECTION

The gangway section 10 is preferably of angle iron construction. The walkway 101 is framed with 2 inch angle iron and covered with treated wood planking. The wood planking is preferably attached to the frame with screws to prevent warping and allow for ease in replacement. The handrail 102 and handrail supports 103 are constructed of 2 inch angle iron and welded together and to the walkway 101. For added strength, the every fourth or fifth handrail support should be constructed of 3 inch angle iron. As would be obvious to anyone skilled in the art, the width and span of the gangway section will dictate many of its structural requirements.

As noted above, the gangway section 10 has controlled freedom of travel along the channel 505 and is restricted from such by the support bars 503 and 504 attached to the handrail supports 103 at its landward end. The waterward end is connected to the gangway section and drawbridge section interconnection crossbeam 202. The preferred method of attachment is by welding tabs to the gangway section 10 and the interconnection crossbeam 202 and bolting them together.

THE ANCHOR SECTION

Figure 12:
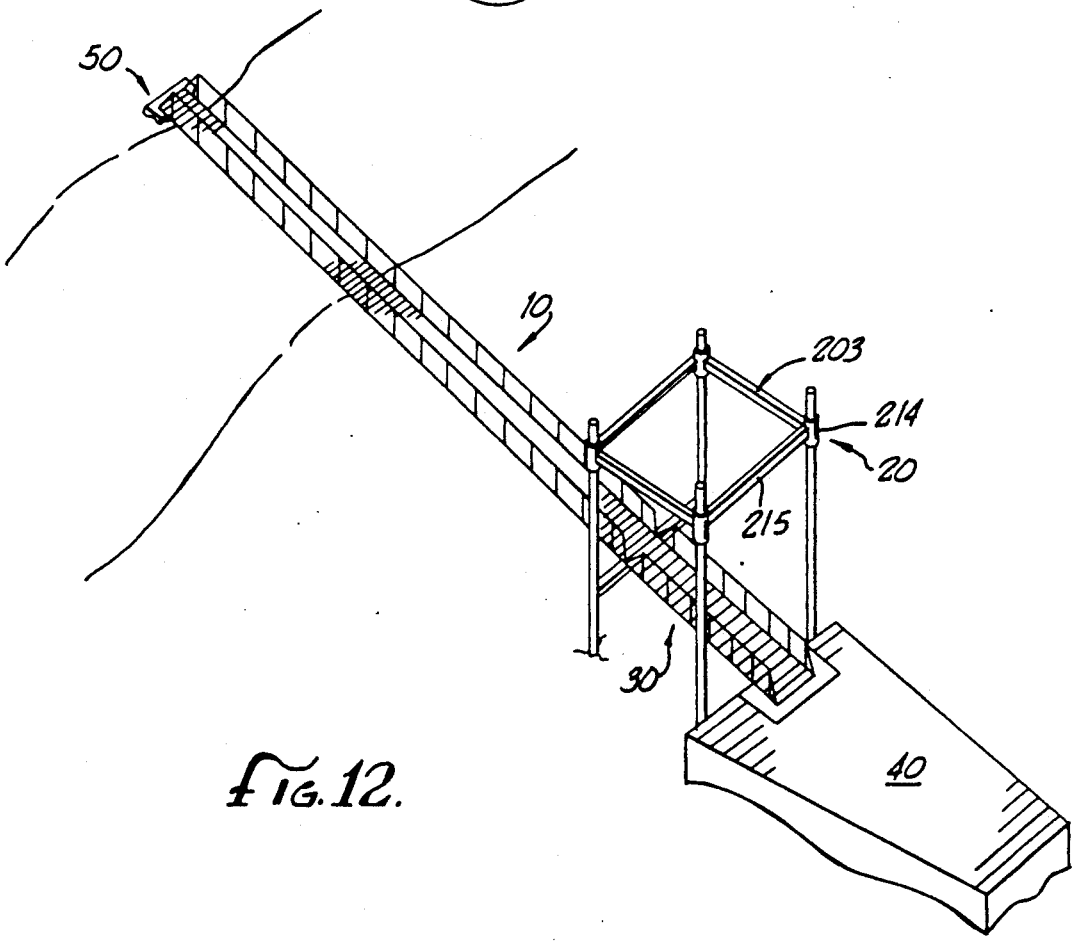
FIG. 12 is a perspective view of the dock system depicted in FIG. 1.

In the preferred embodiment the anchor section 20 is comprised of four pencil anchors 201, an interconnection crossbeam 202, a superstructure 203 and a submerged structure 204. As shown best in FIG. 12 the superstructure 203 is comprised of 4 sleeves 214 having a diameter slightly larger than the pencil anchors 201 and are connected by four crossbars 205. The submerged structure in the preferred embodiment is identical to the superstructure. These two structures help maintain the four pencil anchors in relative alignment for stability. If the pencil anchors are driven into the lake bottom, the submerged structure may not be necessary. If the pencil anchors rest on a rocky lake bottom, the submerged structure will restrict independent movement of the anchors. Additionally, as described above, guy wires 507 may be employed when encountering rocky bottoms to help maintain proper alignment of the four pencil anchors. The superstructure and submerged structure in the preferred embodiment are attached to the pencil anchors 201 in the same manner as the interconnection crossbeam, which is described below. In certain applications these structures may be permanently welded to the pencil anchors.

Figure 14:
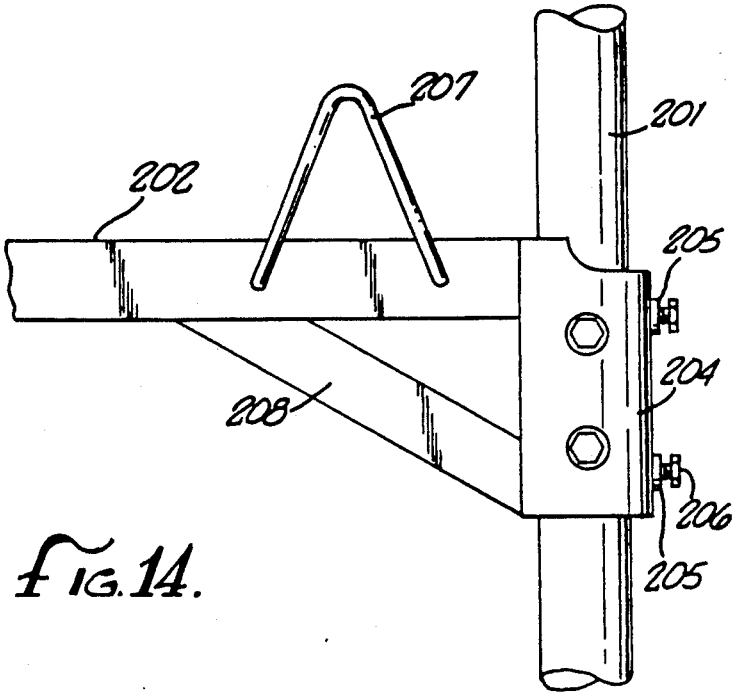
FIG. 14 is an enlargement of the pencil anchor attachment mean of the gangway section and drawbridge section interconnection crossbeam depicted in FIG. 13.

Referring to FIG. 14, the interconnection crossbeam 202 is preferably comprised of four inch angle iron formed into a 4x4 rectangular tube. The ends of the crossbeam 202 are welded to two sleeves 204. Depending on the size and design of the anchor section 20, the crossbeam 202 and the gangway section 10, additional structural supports 208 may be necessary. As best shown in FIG. 14, in the preferred embodiment, through holes are drilled in the sleeves 204 and nuts 205 welded in alignment thereto. At least two bolts 206 per sleeve, preferably four, are threaded into the nuts and tightened against the pencil anchors 201. This rigidly secures the crossbeam 202 to the anchors 201 while allowing for adjustment to compensate for radical changes in the water level. For example, if the water level drops, the crossbeam 202 may be lowered to compensate for this drop.

Because of the weight of the gangway section 10 and the crossbeam 202 itself, raising/lowering eyes 207 are welded to the crossbeam 202 to facilitate adjustment of the crossbeam 202. When the crossbeam 202 is to be lowered or raised, a come-along hoist may be connected between the raising/lowering eyes 207 and a similar eye on the superstructure. The bolts 206 are then loosened (as well as the bolts connecting the gangway section 10 to the crossbeam 202 and at the shoreline mooring section 50), and the crossbeam is set at the desired height through adjustment of the come-alongs. If the dock system includes the shoreline mooring section described above, when the crossbeam is lowered to compensate for drops in the water level, the gangway section 10 easily rolls along the channel 505 to compensate for the lowering. Thus, one person can easily accomplish this otherwise difficult task.

THE FLOATATION SECTION

Figure 11:
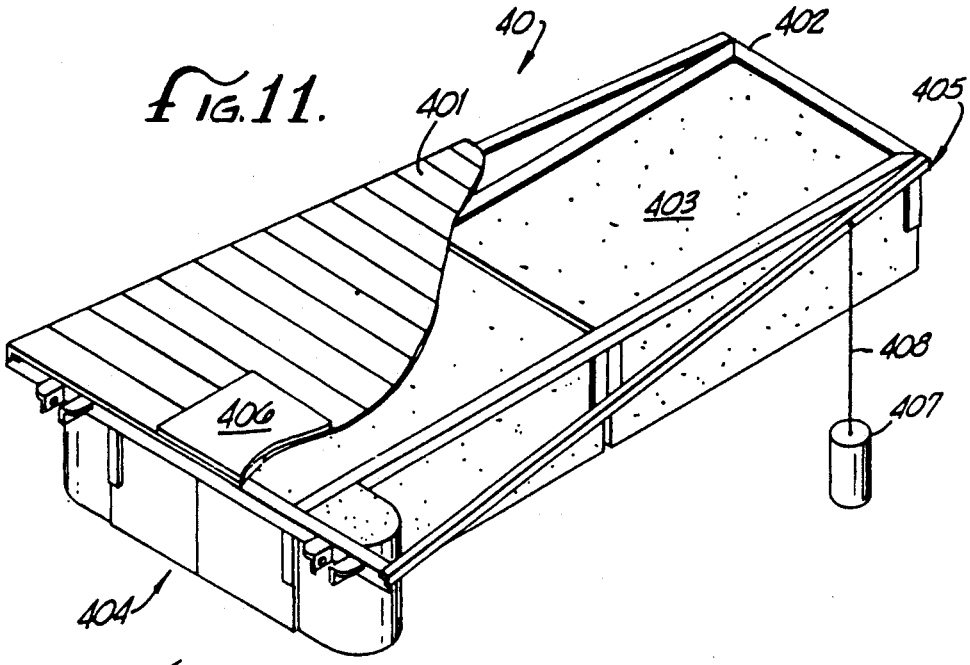
FIG. 11 is a perspective view of the floatation section of the dock system depicted in FIG. 1 with the walking surface removed.

The floatation section 40 of the preferred embodiment is best seen in FIG. 11. It is comprised of a walking surface 401 preferably treated wood, attached by screws to a frame 402. The frame 402 is preferably constructed from various sizes of angle iron. An appropriate, light density material, preferably polystyrene, is used as fill 403 to provide the appropriate bouancy. The size and shape of the floatation section 40 will be dictated by the application. It has been found to be advantageous to include wave cushioners at the waterward end 405 of the platform 40. These preferably are sea anchors 407 attached by cables 408.

Figure 8:
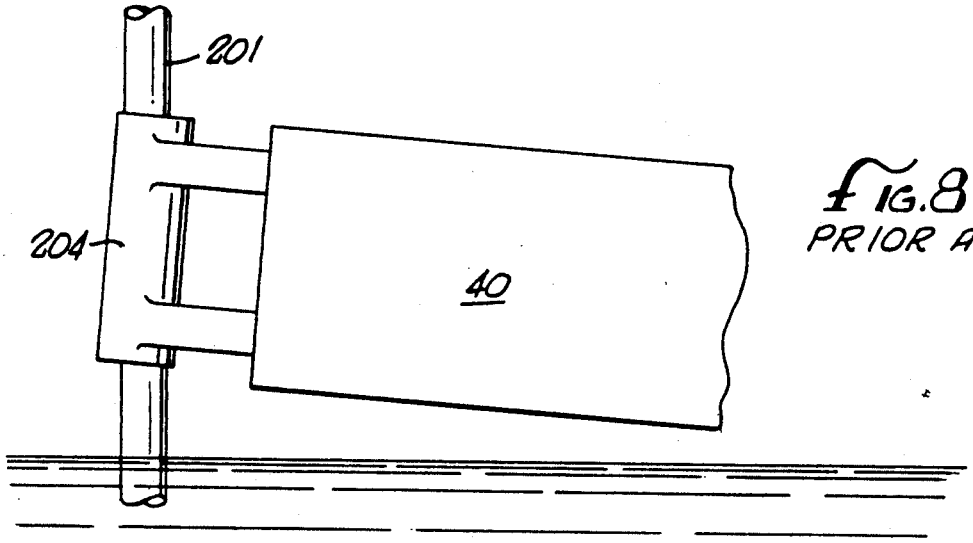
FIG. 8 PRIOR ART
FIG. 8 is a partial side view taken along plane 8—8 of FIG. 7.
Figure 15:
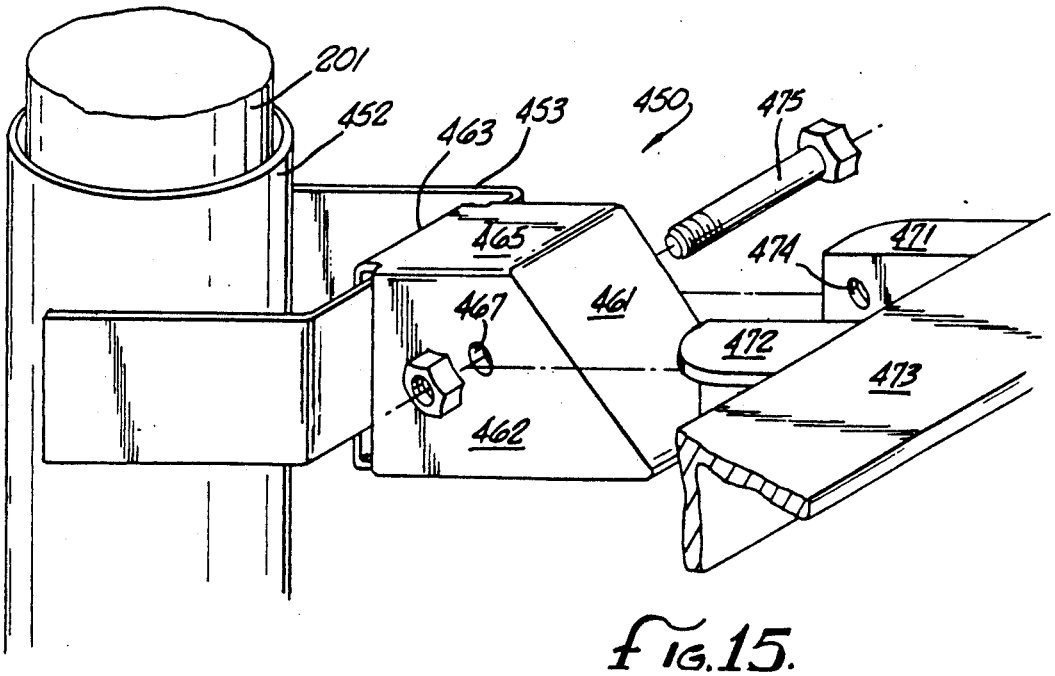
FIG. 15 is an exploded perspective view of an antihang-up coupler.

The floatation section of the preferred embodiment comprises a landward end 404 and an waterward end 405. The landward end 404 is coupled to the anchor section 20. As seen in FIG. 15 the coupling is achieved through the use of multiple degree of freedom couplers 450. These couplers 450 prevent the floatation device from hanging-up on the pencil anchors, a common problem of prior art dock systems, an example of which is depicted in FIG. 8.

Figure 16:
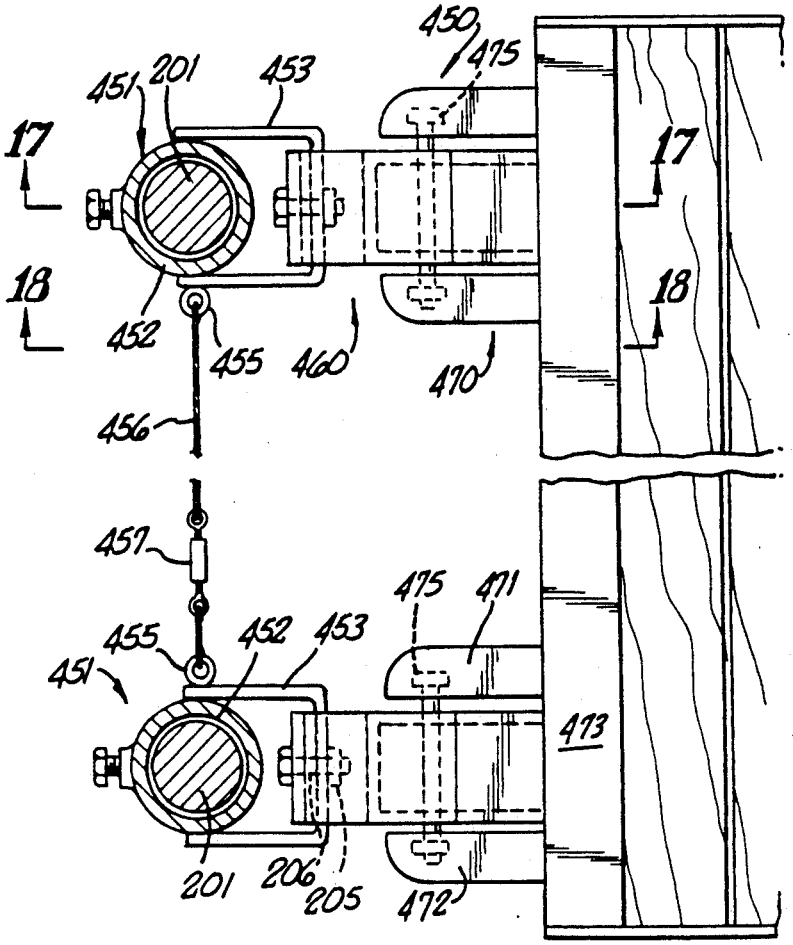
FIG. 16 is a partial plan view of two antihang-up couplers used on the dock system depicted in FIG. 1 at plane 16—16 of FIG. 2*d*.
Figure 17:
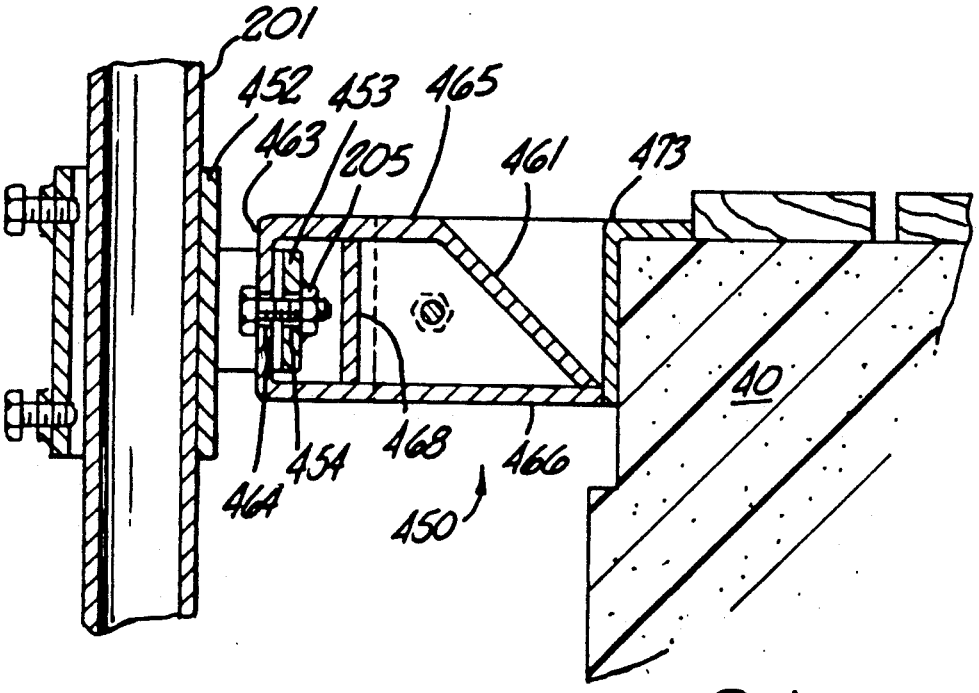
FIG. 17 is a cross sectional view taken along plane 17—17 of FIG. 16.
Figure 18:
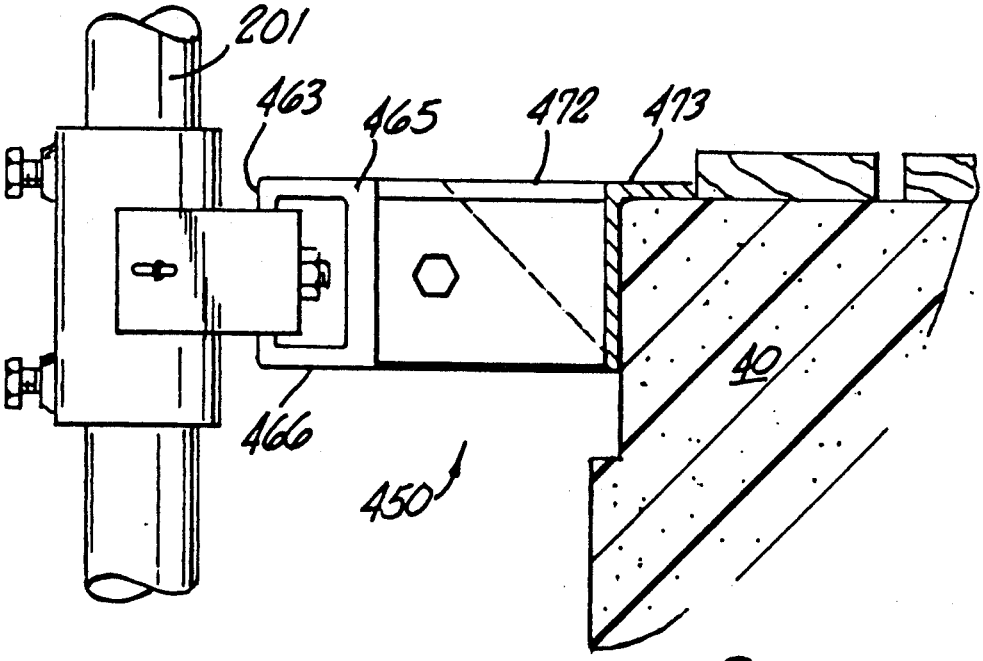
FIG. 18 is a partial side view taken along plane 18—18 of FIG. 16.

The multiple degree of freedom anti-hangup couplers 450 comprise a guide assembly 451, an anti-hangup link 460 and a one-way mounting assembly 470. As seen in FIG. 16 the guide assembly 451 is comprised of a cylinder 452 and a U-strap 453. The cylinder 452 is of a slightly larger diameter than the diameter of the pencil anchors 201, preferably 16%. In the preferred embodiment the pencil anchors 201 are 5.5 inches in diameter and the cylinder 452 is 6.0 inches in diameter. The U-strap 453 is preferably centrally located on the cylinder 452 and perpendicular to the cylinder's 452 longitudinal axis. Attachment may be accomplished by welding. The pencil anchor 201 extends through the cylinder 452 without being attached to the cylinder 452, thereby allowing the cylinder 452 virtually unrestricted vertical movement the length of the pencil anchor 201, while substantially restricting horizontal movement of the cylinder 452. A through hole 454 is included on the U-strap 453. Preferably a nut 205 is aligned with the through hole 454 and welded in place; however, if desired, the through hole 454 can be threaded. For ease in maintenance and assembly a nut 205 and bolt 206 assembly can be included on the cylinder 452 for locking the cylinder 452 in place on the pencil anchor 201, when the floatation section is removed, for example.

The anti-hangup link 460 is comprised of an angled face 461, side plates 462 and a C-strap 463. The C-strap 463 includes a through hole 464 that can be aligned with the through hole 454 formed in the U-strap 453. The link 460 is assembled with the U-strap 453 and C-strap 463 interlinked and the through holes 454 and 464 aligned. A bolt 206, is passed through the aligned through holes 454 and 464. The bolt is threaded, but not tightened, into the nut 205, and keyed or welded in place, to act as a pin. Thus, the link 460 and the guide 450 are pinned together in such a manner to allow the link minimal rotation, preferably 10 to 15 degrees, with respect to the guide 450.

The C-strap 463 has a top plate 465 and a bottom plate 466. The side plates 462 are welded parallel to each other to the top and bottom plates 465 and 466. Each side plate 462 includes a through hole 467 which are aligned. The angled face 461 is attached to the side plates 462 at an angle preferably between 30 and 60 degrees, most preferably at 45 degrees. To minimize the possibility of corrosion of the link 460, the side plates 462, top plate 465, bottom plate 466 and angled face 461 are attached in such a manner that they form the four sides and bottom of a box. An endplate 468 is then welded to the side plates 462, top plate 465 and bottom plate 466 to form a sealed box.

The mounting assembly 470 comprises a first and second support member 471 and 472 and a stop bar 473. The support members 471 and 472 are attached parallel to each other and perpendicular to the stop bar 473 and spaced a distance apart slightly greater than the width of the anti-hangup link 460. Each support member 471 and 472 includes a through hole 474. These through holes 474 are aligned with each other and positioned such that when they are aligned with the through holes 467, the end of the angled face 461 abuts against the stop bar 473. Alternatively the angled face could be positioned to extend a small distance under the stop bar 473, about one inch. A pin, preferably a bolt and nut assembly 475, extends through the through holes 467 and 474. In this arrangement the mounting assembly 470 can only rotate upward around the pin with respect to the link 460.

It has proven advantageous when using two anti-hangup couplers 450 to include a dampening assembly. In the preferred embodiment the dampening assembly comprises a pair of eyebolts 455 securely fastened to the guide assemblies, a dampening cable 456 stretched between the eyebolts 455 and an adjuster 457. The adjuster 457, which is a heavy duty turnbuckle in the preferred embodiment, should be adjusted so that the guide assemblies 451 movements are smooth, e.g., such that each pencil anchor 201 abutts the cylinder 452 along a single line. This dampening assembly minimizes the beating that the pencil anchors receive during rough weather.

Figure 9:
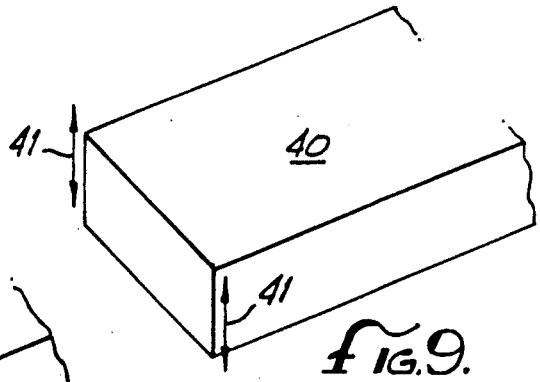
FIG. 9. PRIOR ART
FIG. 9 is a diagrammatic representation of the limited motion of the floatation section of the prior art docks depicted in FIG. 7.
Figure 10:
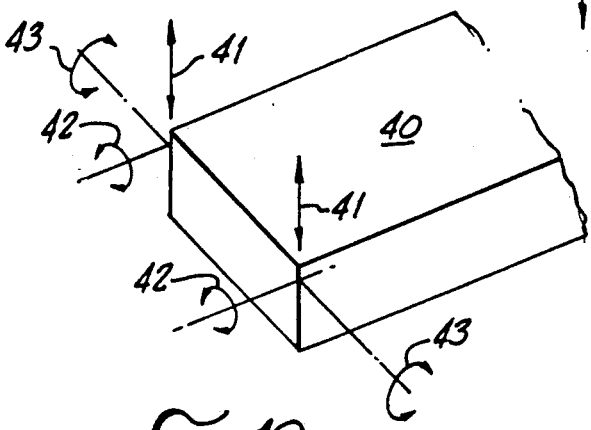
FIG. 10 is a diagrammatic representation of the freedom of movement of the floatation section of the dock system depicted in FIG. 1.

In the preferred embodiment the stop bar 473 forms part of the frame at the landward end of the floatation platform. When the floatation platform 40 is attached to the anchor assembly with the multiple degree of freedom couplers 450 the problem of the floatation platform hanging up on the pencil anchors during rough weather, is eliminated. The reason for this can best be understood with reference to the diagrams shown in FIGS. 9 and 10. The prior art systems only allow the floatation platforms to freedom of one movement in one direction, vertically as depicted by the bidirectional arrows 41. When the water has only large gentle swells or waves, the prior art system performs adequately because the sleeves 204 slowly slide up and down the pencil anchors 201 allowing the platform to gently ride the waves. As is frequently the case on large lakes, the water gets rough. In rough water, when the waves are shorter than the length of the platform or are high, the prior art system fails. While one end of the platform is at the crest of a wave, the other end is in a trough and the platform hangs up as shown in FIG. 8.

The present system avoids this problem by allowing the ends of the floatation platform 40 independent movement. The corners of the floatation platform can rotate about the x-axis as shown by arrow 42 and the y-axis as shown by arrow 43 as well as being able to travel freely along the z-axis as shown by arrow 41. In rough water the waterward end of the platform can easily pivot upward (around the pin 475 in the preferred embodiment) without exerting any significant rotational force on the guide assembly 451. Thus, the guide assembly 451 will rise and fall without hanging up. The interlinking C-strap 463 and U-strap 453 also allow both landward corners of the floatation platform a certain degree of independent movement such that if one corner is on a crest and the other a trough, no significant rotational force is exerted on the guide assembly 451. Again, hanging-up is avoided. Additionally, the one-way rotation feature, prevents the waterward end of the floatation platform from being submerged. When the landward end is on a crest and the waterward end is in a trough, the stop bar 473 keeps the waterward end high and the platform substantially level such that the next wave does not strike the platform when it is at an angle.

THE DRAWBRIDGE SECTION

In the preferred embodiment, access between the gangway section 10 and the floatation platform 40 is accomplished by the drawbridge section 30. The bridge 301 is constructed in much the same fashion as the gangway section 10, using a frame 101, handrail supports 103 and a handrail 102. The handrails 102 are spaced further apart than the handrails 102 on gangway section 10 to prevent interference with each other when the drawbridge is raised.

Figure 3:
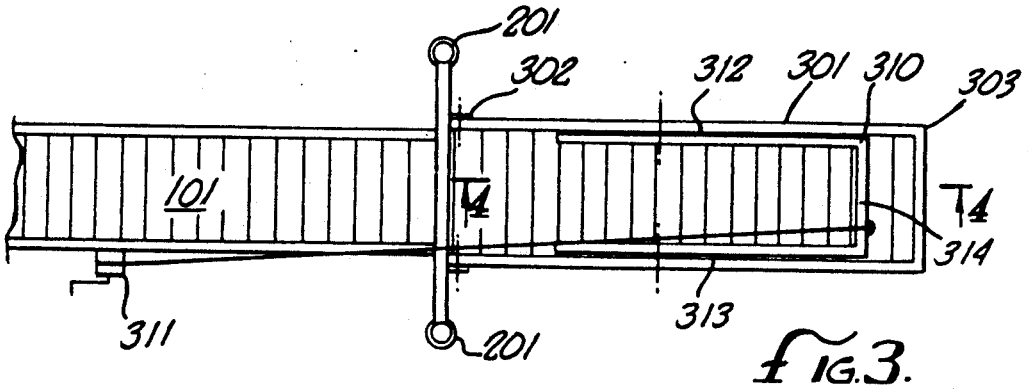
FIG. 3 is an overhead plan view of the drawbridge of the dock system of FIG. 1.
Figure 4:
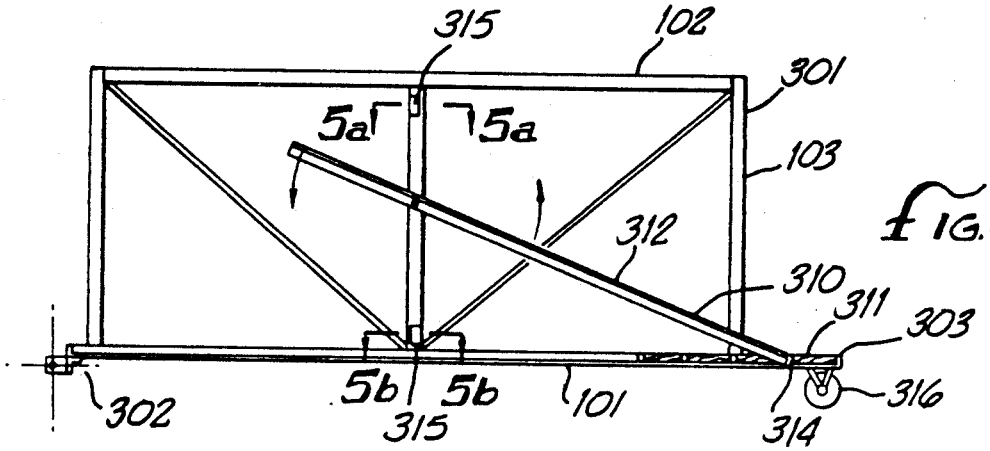
FIG. 4 is a partial side view taken along plane 4—4 of FIG. 3.
Figure 13:
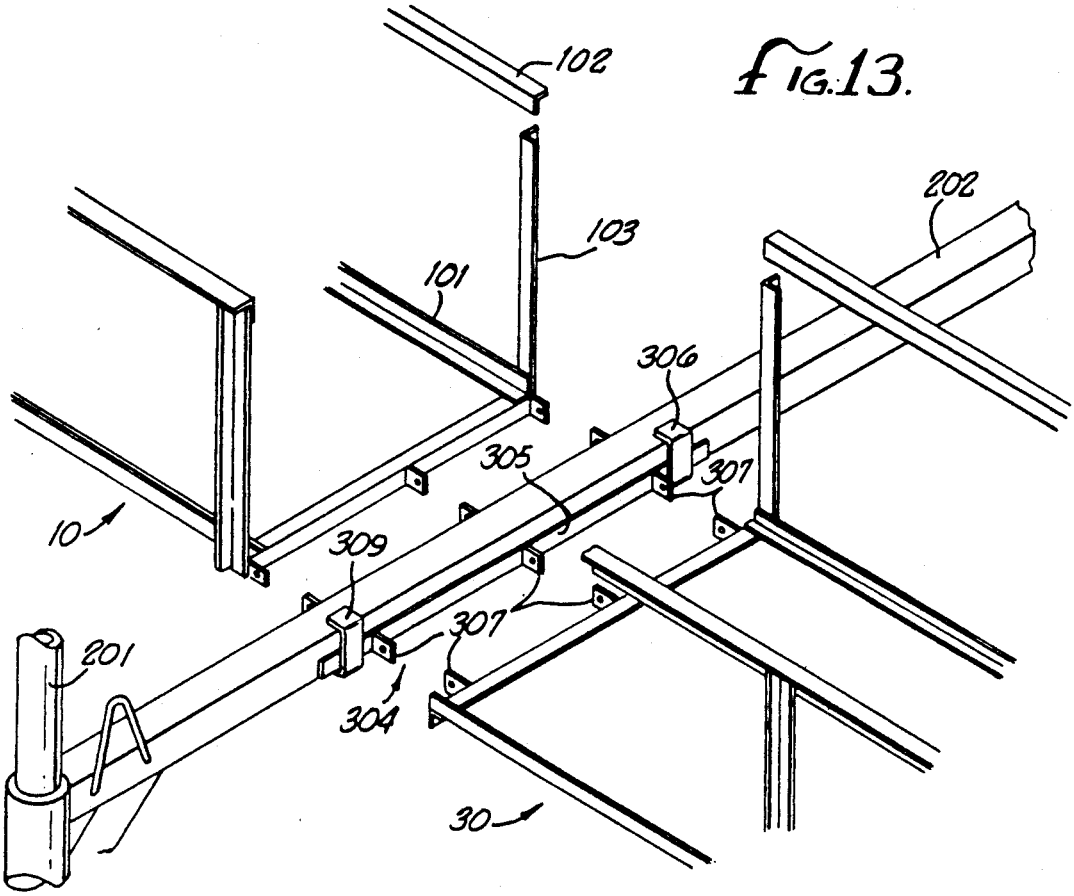
FIG. 13 is an exploded perspective view of the gangway section and drawbridge section interconnection crossbeam and the slidable hinge of the drawbridge section of the dock system depicted in FIG. 1.

As shown in FIGS. 3, 4 and 13, the drawbridge section comprises a bridge 301 having a hinged end 302 and a free end 303. The hinged end 302 is connected to the interconnection crossbeam 202 with a sliding hinge assembly 304. The sliding hinge assembly 304 is comprised of a slide bar 305, a first and second slide bracket 306 and 307 and a set of three hinges 309. The hinges 309 are comprised of two tabs and a pin. One tab for each hinge is attached to the slide bar 305 and the other tab is correspondingly attached to the bridge 301. The slide brackets 306 are welded to the crossbeam 202, capturing the slide bar 305 while allowing it to slide horizontally and move vertically with respect to crossbeam 202. This allows the hinged end 302 if the bridge 301 to follow the free end of the bridge with minimal twisting and without imparting excess rotational movement. In the preferred embodiment the slide bar 305 and the slide brackets 306 and 307 are constructed from half-inch flat stock. For most efficient use, heavy duty grease should be generously applied along the length of the slide bar 305.

Figure 5A:
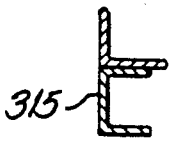
FIGS. 5*a* and 5*b* are cross sectional views taken along planes 5*a*—5*a* and 5*b*—5*b*, respectively, of FIG. 4.
Figure 5B:
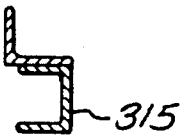

The bridge raising assembly is comprised of a lift bar 310 and a raising means, which in the preferred embodiment is a ratcheted hand operated winch 311. The lift bar 310 is formed in a U-shape and comprises two pivot arms 312 and 313 which are interconnected by a crossmember 314. The pivot arms 312 and 313 are pivotally attached to the bridge 301 at a point a distance above the walking surface 311. This is advantageously accomplished by pinning them to one of the handrail supports 103 on each side of the bridge 301. When the bridge 301 is in the lowered position the crossmember 314 extends across the bridge 301 lying flush on the walking surface 311. As shown best in FIGS. 4, 5*a* and 5*b*, lift bar stops 315 are mounted above and below the pivot point of attachment.

To raise the bridge 301, the cable from the raising means, which is mounted on the gangway section 10 at some convenient point, is attached to the lift bar 310, preferably at on the crossmember 314 by means of an eye and hook assembly. The raising means is then engaged. In the preferred embodiment, the hand crank is rotated. The lift bar 310 is slowly raised until it comes into contact with the lift bar stops 315. At this point, continued raising will begin to lift the bridge 301, swinging it upward around the sliding hinge assembly 304. Once the bridge has been raised the raising means can be locked in place to prevent unauthorized lowering of the bridge 301.

Figure 2A:
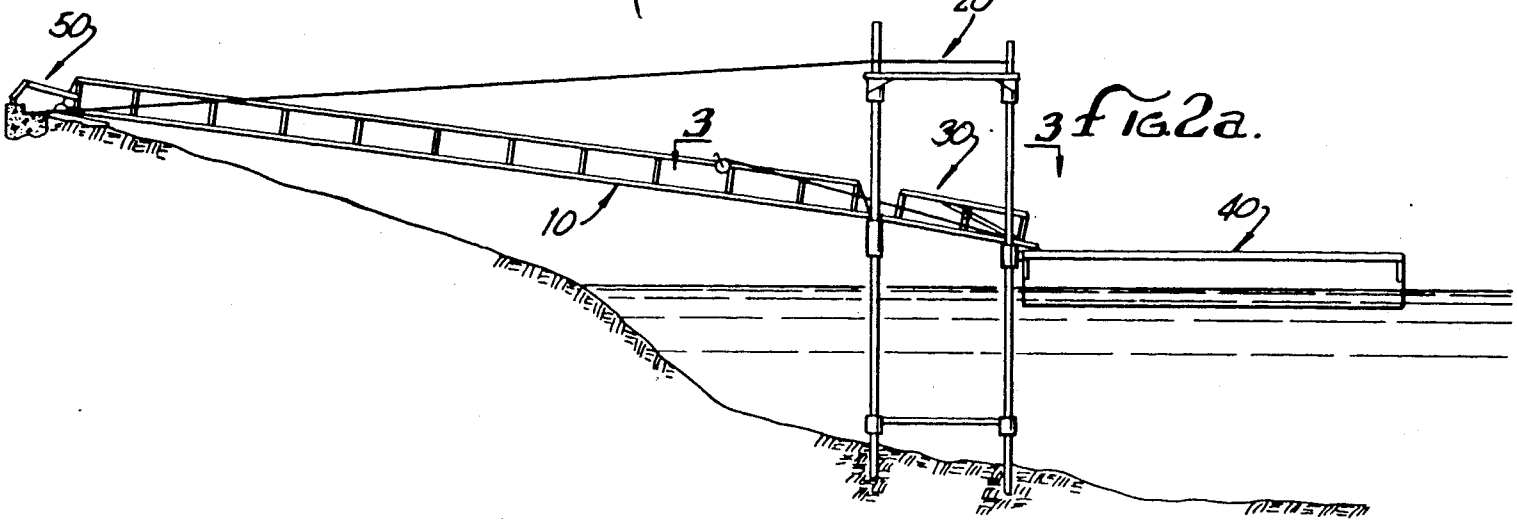
FIG. 2*a* is a side view of the dock system of FIG. 1.
Figure 2B:
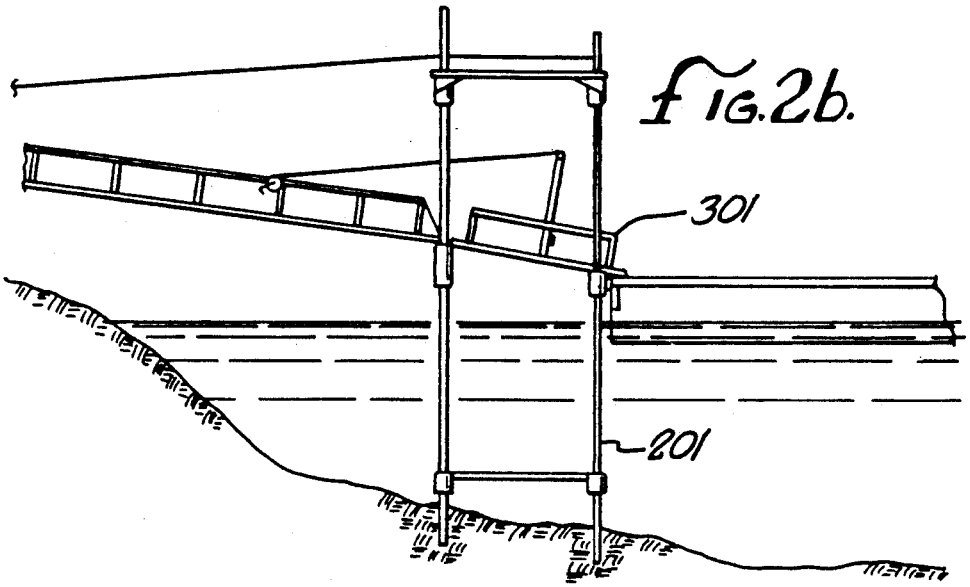
FIGS. 2*b* through 2*d* are partial side views of the drawbridge section of the dock system of FIG. 1.
Figure 2C:
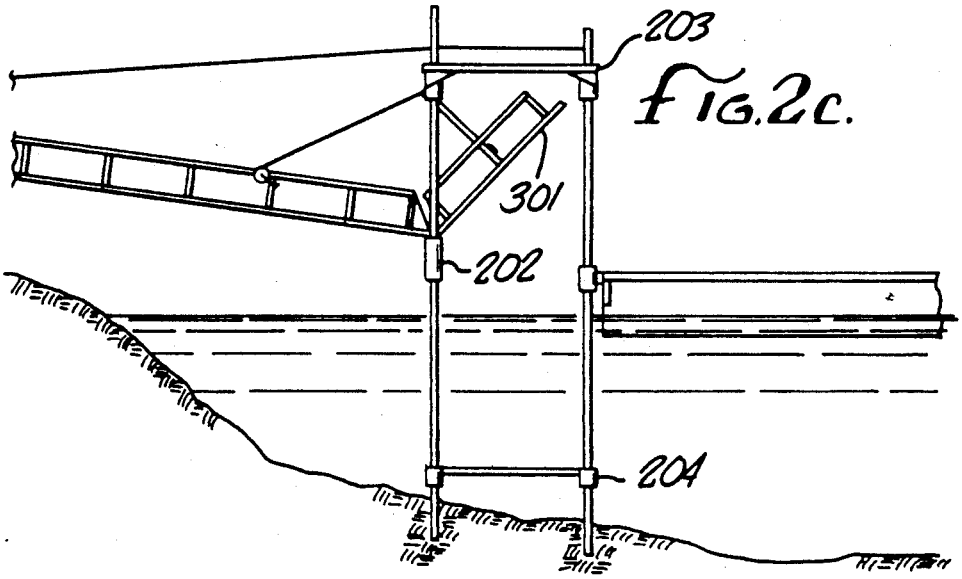
Figure 2D:
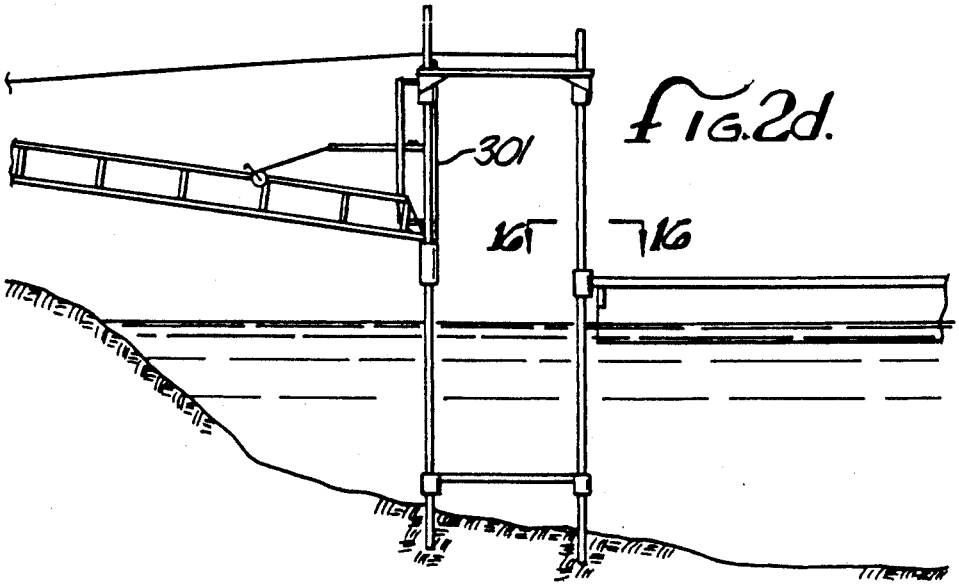

The operation of the drawbridge section is best shown in FIGS. 2*a* through 2*d*. When the bridge 301 is in the fully raised position as shown in FIG. 2*d*, a moat has in effect been created between the gangway section 10 and the floatation section 40. This provides security from people accessing the floatation platform 40 from land and hence any boat moored to the platform. Additionally the raised bridge 301 also prevents people from mooring to the platform and gaining access to the land.

In the lowered position the free end 303 of the bridge 301 overhangs and rests on the floatation platform 40. Since the platform 40 floats freely and rises and falls with the water, rollers 316 are attached to the bridge 301 and ride on the platform 40. A roller plate 406, preferably constructed from eighth inch plate steel, is attached to the walking surface 401 of the floatation platform at the landward end 404 for the rollers 316 to roll on.

Accordingly, a mooring system incorporating the present invention has been described herein in detail. While various embodiments have been discussed, highlighting the novelty and usefulness of the system, as would be apparent to those skilled in the art to whom this invention is directed, many more embodiments and application of the invention are possible without deviating from the scope and nature of the invention. The invention therefore is not to be restricted or limited except in accordance with the claims set forth below.

I claim as follows:

1. In a mooring system for use on a body of water and having an anchoring structure and a floatation platform including a waterward end, a coupler comprising means for attaching said coupler with said anchoring structure to permit substantially unrestricted independent movement of said coupler in a direction substantially perpendicular to the surface of the water with substantially restricted movement of said coupler in a direction substantially parallel to the surface of the water; a link member coupled to said attachment means; means for allowing limited rotation of said link member with respect to said attachment means about a horizontally disposed axis perpendicular to said direction of movement of said coupler and means for allowing the waterward end of said floatation platform to pivot upward around said link member while preventing said floatation platform from pivoting downward substantially below the horizontal plane defined by said attachment means and said pivot means.

2. In a mooring system for use on a body of water and having pencil anchors and a floatation platform, an anti-hangup coupler comprising a guide assembly having a diameter slightly larger than the diameter of said pencil anchors; an anti-hangup link and a mounting assembly; said pencil anchors extending through said guide assembly and said guide assembly being interlinked with said anti-hangup link; said anti-hangup link being pinned to said mounting assembly and said mounting assembly being rigidly attached to said floatation platform, said guide assembly being capable of substantially unrestricted independent movement relative to said pencil anchors in a direction substantially perpendicular to the surface of the water and said anti-hangup link being capable of limited rotation relative to said guide assembly.

3. The coupler claimed in claim 2 wherein said guide assembly comprises a hollow cylinder and a U-strap, said cylinder having a first and second end, said U-strap having a first and second free end; said first and second free ends of said U-strap are mounted to the sides of said cylinder, approximately the same distance from said first end and said second end of said cylinder such that an opening is formed parallel to the longitudinal axis of said cylinder.

4. The coupler claimed in claim 2 wherein said anti-hangup coupler comprises a C-strap attached to two side plates and an angled face.

5. In a mooring system for use on a body of water and having a floatation platform, an anti-hangup coupler comprising a guide assembly; said guide assembly comprising a hollow cylinder and a U-strap, said cylinder having a first and second end, said U-strap having a first and second free end; said first and second free ends of said U-strap being mounted to the sides of said cylinder, approximately the same distance from said first end and said second end of said cylinder such that an opening is formed parallel to the longitudinal axis of said cylinder; an anti-hangup link and a mounting assembly; said anti-hangup coupler comprising a C-strap attached to two side plates and an angled face; said guide assembly being interlinked with said anti-hangup link; said anti-hangup link being pinned to said mounting assembly and said mounting assembly of said anti-hangup coupler being rigidly attached to said floatation platform.

* * * * *